United States Patent [19]

Katzer et al.

[11] Patent Number: 5,052,621

[45] Date of Patent: Oct. 1, 1991

[54] DRIVE MECHANISM FOR A SPRINKLER OR THE LIKE

[75] Inventors: Johann Katzer, Neu-Ulm; Wolfgang Lindermeir, Untermarchtal; Franz Lopic, Nersingen, all of Fed. Rep. of Germany

[73] Assignee: Gardena Kress + Kastner GmbH, Fed. Rep. of Germany

[21] Appl. No.: 409,830

[22] Filed: Sep. 20, 1989

[30] Foreign Application Priority Data

Oct. 6, 1988 [DE] Fed. Rep. of Germany ..... 3833984

[51] Int. Cl.[5] ..... B05B 3/16

[52] U.S. Cl. ..... 239/242

[58] Field of Search ..... 239/124, 126, 240, 242

[56] References Cited

U.S. PATENT DOCUMENTS

| | | | |
|---|---|---|---|
| 3,107,056 | 1/1961 | Hunter | 239/206 |
| 3,149,784 | 9/1964 | Skidgel | 239/240 |
| 3,383,047 | 1/1968 | Hauser | 239/206 |
| 3,713,584 | 1/1973 | Hunter | 239/206 |
| 3,785,565 | 1/1974 | Perry et al. | 239/206 |
| 3,915,383 | 10/1975 | King | 239/242 |
| 3,934,820 | 1/1976 | Phaup | 239/240 |
| 4,069,976 | 1/1978 | Chauvigné | 239/242 |
| 4,201,344 | 5/1980 | Lichte | 239/242 |
| 4,232,827 | 11/1980 | Roman | 239/242 |
| 4,417,691 | 11/1983 | Lockwood | 239/206 |
| 4,568,023 | 2/1986 | Hayes | 239/242 |
| 4,721,248 | 1/1988 | Chow | 239/242 |
| 4,773,595 | 9/1988 | Livne | 239/242 |
| 4,842,201 | 6/1989 | Hunter | 239/240 |
| 4,892,252 | 1/1990 | Bruninga | 239/240 |

FOREIGN PATENT DOCUMENTS

| | | | |
|---|---|---|---|
| 1002982 | 2/1957 | Fed. Rep. of Germany . | |
| 6909765 | 3/1969 | Fed. Rep. of Germany . | |
| 1912315 | 10/1970 | Fed. Rep. of Germany . | |
| 1782094 | 1/1972 | Fed. Rep. of Germany . | |
| 2248065 | 4/1974 | Fed. Rep. of Germany . | |
| 2415146 | 10/1974 | Fed. Rep. of Germany . | |
| 2631752 | 1/1977 | Fed. Rep. of Germany . | |
| 2112881 | 6/1972 | France . | |
| 2626498 | 8/1989 | France | 239/240 |
| 1508179 | 4/1978 | United Kingdom . | |
| 2032745 | 5/1980 | United Kingdom . | |

OTHER PUBLICATIONS

Garten Magazin '82, Gardena.

Garten Magazin '87, Gardena, pp. 10 & 11.

*Primary Examiner*—Andres Kashnikow

*Assistant Examiner*—Michael J. Forman

*Attorney, Agent, or Firm*—Eckert Seamans Cherin & Mellott

[57] ABSTRACT

In a drive mechanism for a transportable sprinkler or the like, a hydraulic motor has a reduction gear, whose gear or gear wheels are outside the water distribution system in a separate gear chamber and are therefore dry. However, the gear chamber is so integrated into the casing of the hydraulic motor, that it is adjacent to a reversing chamber used for water distribution purposes and in which is located a reversing valve of a reversing device for the alternating reversing of the hydraulic motor in both rotation directions. The hydraulic motor is drive-connected by means of a driven pinion to a support and in the drive connection is arranged a self-engaging safety clutch. Between the reversing chamber and a rotor chamber connected axially thereto and to the gear chamber is provided a pressure-dependently operating bypass water distribution system with simple flap valves. Thus, high operational reliability with extremely compact construction of the hydraulic motor is obtained.

24 Claims, 4 Drawing Sheets

DRIVE MECHANISM FOR A SPRINKLER OR THE LIKE

BACKGROUND OF THE INVENTION

1. Field of the Invention

The invention relates to a drive mechanism for a sprinkler or the like, which has a hydraulic or fluid drive in particular in that at least part of the water to be discharged with the sprinkler is used for driving at least one movement of the sprinkler or the like. For this purpose a liquid or fluid supply is provided in a casing, which is exposed to the action of a drive rotor, which performs the desired movement function by means of a gear.

2. Prior Art

German patent 19 12 315 discloses a sprinkler, in which the drive rotor in the form of a turbine wheel and the gear within a nozzle casing are so located within the water distribution means that the gear is also constantly operating in the waterbath. The gear is mounted on a support fixed to a hollow shaft directly behind the turbine wheel and within the water-filled casing engages in an inner gear rim, which is connected to the casing. This sprinkler has proved to be very advantageous, particularly as its drive mechanism permits a reciprocating movement over an infinitely variable distance and also makes it possible to sprinkle a roughly rectangular area.

SUMMARY OF THE INVENTION

An object of the invention is to provide a drive mechanism of the aforementioned type, which further improves operating efficiency and in particular permits compact construction.

According to the invention this object is achieved in the case of a drive mechanism of the aforementioned type in that the gear is essentially moved out of the water-distributing areas and is preferably located in a separate gear chamber, so that its driven member, e.g. a driven pinion, can be rendered accessible for driving engagement without any special sealing problems and therefore in space-saving manner. Dirtying of the gear by water contaminants is avoided and a particularly easy running of the gear can be achieved through a lubricant or using self-lubricating materials for the gear wheels.

The gear is appropriately placed in a cross-sectionally, substantially circular segmental gear chamber, which can extend over an arc angle of less than 180°, so that it takes up little space.

On the outer circumference the gear chamber is bounded by part of an axially symmetrical or approximately cylindrical casing jacket and within the latter by an e.g. approximately planar partition wall roughly parallel to the casing axis, so that the remaining, optionally larger part of the interior of this casing jacket is available for water distribution purposes.

At the front the gear chamber is closed by partitions, in which can be mounted all the gear shafts and which appropriately pass over the entire inside width of the casing jacket, but are provided with corresponding openings for the passage of water in the vicinity of the water distributing chamber positioned alongside the gear.

The water-distributing chamber, which is at least partly located in the same longitudinal portion of the casing as the gear chamber, can also be used for housing further functional parts of the drive mechanism. Preferably within said chamber is located a reversing valve or the like of a reversing device, with which the drive rotor or the driven pinion of the gear can be driven backwards and forwards alternately in both rotation directions in that, as a function of the rotation path, a reversing member is changed by the movement produced by the drive mechanism. Said longitudinal portion of the casing is subdivided into at least one dry chamber separate from the water distribution system and at least one water-distributing wet chamber, corresponding functional parts being housable in each chamber. Thus, and through the arrangement of the reversing valve at right angles to the casing axis immediately adjacent to the gear it is not only possible to reduce the length of the hydraulic motor, but also its width or diameter to a significant extent, so that its external diameter is roughly the same as its length, namely about 50 mm. The gear could also run in water in the case of this superimposed arrangement.

A chamber receiving the drive rotor is appropriately connected in the longitudinal direction of the casing directly to said longitudinal portion to the front, i.e. towards the water through-flow, whereby said rotor chamber can be separated from the juxtaposed, adjacent chambers by the associated, through partition, in which the drive rotor is to be mounted. The drive rotor is appropriately mounted with a very thin shaft, which is sealingly mounted in the partition and is in driving engagement with the gear within the gear chamber.

According to a further development of the invention the drive rotor axially parallel to the casing is positioned eccentrically with respect to said casing or the rotor chamber located therein, its external diameter being smaller than the inside diameter of the rotor chamber. Thus, the rotor axis of the drive rotor can be on the one hand positioned close to the gear axes and on the other hand between the casing jacket area more remote from the outer circumference of the drive rotor and the latter can be housed in space-saving manner drive nozzles or the associated nozzle ducts, or can be constructed with a relatively large cross-section.

The axial extension of the rotor chamber need only be slightly larger than that of the drive rotor, whilst the axial extension of the transversely divided chambers longitudinally connected thereto need only be roughly as large as the associated gear length. In the vicinity of the rotor chamber the casing can also have a smaller outside diameter than in the vicinity of the gear chamber, so that it is possible for a collar to pass over the rotor chamber from an end cap closing the same and whose outside width is the same as that of the casing in the vicinity of the gear chamber. Thus, in a very simple manner and as a closed subassembly, the hydraulic motor can be mounted by merely plugging into a substantially cylindrical receptacle.

The gear appropriately has a very high reduction ratio, so that the drive rotor can be operated at high speed. As a result of this reduction ratio and the sealed mounting of the drive rotor, the gear can be substantially self-locking, if it is driven from the side of its driven pinion. In order to avoid damage in the case of such a force introduction, it is appropriate to provide in the driving connection between the drive rotor and the component in driving connection with the gear, e.g. a support, post or the like of the sprinkler, a safety clutch, which is appropriately constructed in the manner of a slip clutch. The safety clutch appropriately has clutch members, which under a compressive force in virtually any relative position mesh with one another and the tooth systems thereof can spring over one another counter to the compressive force in the case of overloading.

For mounting the drive mechanism or the hydraulic motor, which appropriately also rotates with the part to be driven with respect to the post or the like, advantageously a shaft is provided, which is connected detachably, but in a substantially rigid manner with the hydraulic motor casing and axially secured with respect to the hydraulic motor the support part pivotable or rotatable with respect thereto, so that the safety clutch can get round its outer circumference. If this shaft is constructed as a hollow shaft, it simultaneously serves as a line connection between a hose connection or the like provided on the support and the hydraulic motor casing. The safety clutch can be provided in drive mechanisms other than that described.

A particularly advantageous further development, particularly of a drive mechanism of the described type, is obtained in that the water flow entering the hydraulic motor casing can be at least partly diverted around the drive rotor as a function of the flow quantity or the pressure in such a way that the corresponding partial flow does not act on the drive rotor in the sense of the drive action, although this partial flow is passed through the rotor chamber and is only kept by guide members from acting on the drive rotor. The partial flow is appropriately controlled by at least one excess pressure valve between a water-distributing chamber positioned laterally alongside the gear chamber and the rotor chamber, the valve closing part in the form of a simple plate in the rotor chamber being resiliently pressed against a passage opening in such a way that on reaching a predetermined pressure it rises and allows a through-passage, whilst getting round the valve duct or ducts. Appropriately two valve closing parts are formed by the tongue-like ends of a flat material strip, which is only fixed to the associated partition roughly in the centre between these ends and consequently forms two oppositely directed projecting spring arms and with its ends the valve closing parts. This leads to a very simple and compact construction, particularly as the spring arm or arms can be arranged between the valve ducts and rotor axis or between the partition and the facing end face of the drive rotor at a spacing from the rotor axis which is smaller than half the external diameter of the drive rotor.

These and further features of preferred developments of the invention can be gathered from the claims, description and drawings. The individual features can be realized singly or in the form of subcombinations in an embodiment of the invention and in other fields and can constitute independently protectable constructions for which protection is hereby claimed.

BRIEF DESCRIPTION OF THE DRAWINGS

An embodiment of the invention is described in greater detail hereinafter relative to the drawings, wherein.

DETAILED DESCRIPTION OF THE PREFERRED EMBODIMENTS

Figure 1:
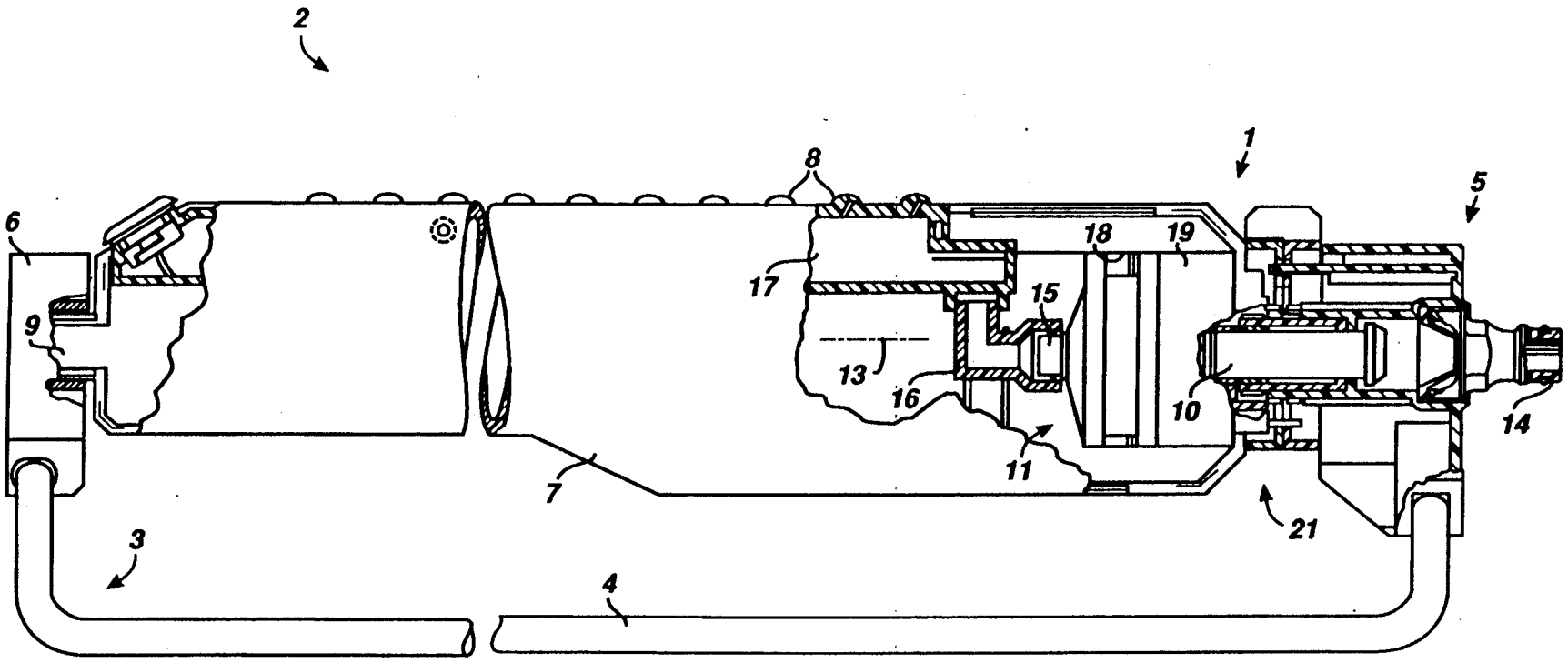
FIG. 1 shows a sprinkler provided with an inventive drive mechanism in part sectional view.
Figure 2:
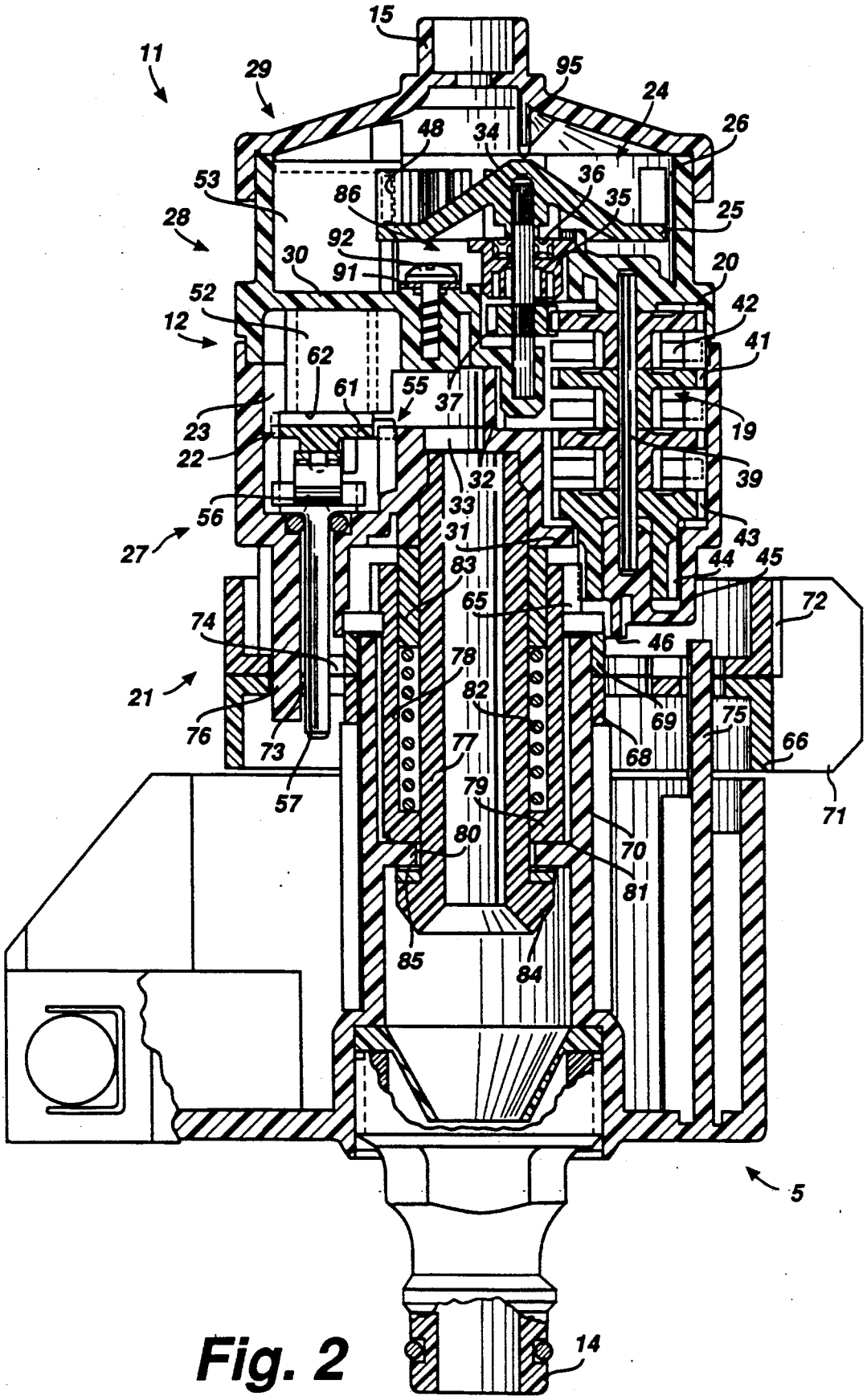
FIG. 2 shows the mechanism according to FIG. 1 on a larger scale and substantially in axial section, but turned by 90°.

As is more particularly apparent from FIG. 1, a drive mechanism 1 according to the invention is e.g. intended for the swivelling or pivoting operation of a sprinkler 2, which can be set up with the aid of a post 3, a tie rod, etc. Post 3 has in the represented embodiment two V-shaped, downwardly diverging, approximately U-shaped clips 4 extending in the longitudinal direction of the sprinkler and whose ends are laterally inserted in two end supports 5, 6 and with these form the bracket or the fixed or immovable component of the sprinkler 2 and between which is mounted a nozzle casing 7 as a movable component driven by the drive mechanism 1. The nozzle casing 7 has on its top surface at least one longitudinal row of differently oriented spray nozzles 8 from which, in substantially one plane, passes a type of water curtain, which can be inclined to the left and/or right, considered in the longitudinal direction, by the swivelling movement and in this way it is possible to sprinkle an area of adjustable size, e.g. a lawn or flowerbed.

The approximately cylindrical casing, which is downwardly widened in the vicinity of the drive mechanism 1, has on the front end remote from the drive mechanism 1*a* journal 9 engaging in a bearing opening of the associated support 6. The other end of the nozzle casing 7 forming the nozzle support is mounted in the associated support 5 with a hollow shaft 10 projecting above said end. The nozzle casing 7 is appropriately constituted by two lateral plastic half-shells, which engage in groove and tongue manner and are interconnected in liquid-type manner by ultrasonic welding or the like.

The drive mechanism 1 has as its drive motor a fluid-operated motor in the form of a hydraulic motor 11 forming with a base 12 a closed component, which is substantially completely located within the nozzle casing 7 and only projects with a short rear end portion from the rear end of the nozzle casing or box 7 for gear connection with support 5. The horizontal central axis 13 of hydraulic motor 11 coincides with the rotation or swivel axis of nozzle casing 7, the hollow shaft 10 being fixed in the rear end of base 12 and rotatably mounted in the plastic support 5. Immediately behind and equixially to the hollow shaft 10 is provided in the associated end face of support 5 a connection for a water line in the form of a hose connection, preferably a plug coupling member of a fast coupling. By means of the hose connection 14 through hollow shaft 10 the interior of base 12 for the hydraulic motor 11 is supplied with pressure water and this then completely passes out again through the wate exit connection 15 on the front end of base 12. On the connecting piece-like water exit connection 15 located in central axis 13 is engaged one end of an angular line or pipe bend 16 in sealed manner and its other end is inserted from below in a nozzle line 17 located in casing 7. Nozzle line 17 extends in the longitudinal direction of nozzle casing 7 over all the spray nozzles 8, so that they are connected with the inner ends of their nozzle bores jointly and directly to the nozzle line 17, whose cross-sections are substantially or many times smaller than that of the nozzle casing 7. Base 12 of hydraulic motor 11 is inserted directly behind line 17 in centred manner in a receptacle 18 of casing 7 and is e.g. prevented from rotation by cams engaging in the rear end wall of nozzle casing 7. The receptacle 18 can be formed by several circumferentially distributed ribs or the like, which engage on the outer circumference of base 12.

In the rear end of the base 12 of the hydraulic motor 11 constructed as a geared motor is provided a multi-stage, namely five to ten stage and preferably eight stage reduction gear 19, whereof a first gear stage can be formed by the inlet-side drive connection of the gear and a further gear stage by the outlet-side drive connection. Gear 19 is located in a gear chamber 20 of base 12 sealed from the water distribution system between hollow shaft 10 and water exit connection 15, the length of chamber 20 being roughly half the size of the external diameter of base 12 in its vicinity.

For the alternating reversal of the pivoting direction of nozzle casing 7 is provided a reversing device 21, which has a reversing valve 22 operated by the pivoting movement between two control positions. This reversing valve 22 is positioned in a control chamber 23, which is located in the same longitudinal portion of base 12 as the gear chamber 20, but is connected to the water distribution system between hollow shaft 10 and the water exit connection 15 or directly to the associated end of hollow shaft 10.

The water flowing through the water ditribution system drives a drive rotor 24 of the hydraulic motor, said rotor 24 having in a rotor chamber 26 a turbine wheel 25 exposed to at least one nozzle jet. Within the base 12, the said rotor chamber 26 is provided axially directly following the gear chamber 20 and reversing chamber 23. However, in the vicinity of rotor chamber 26, the base 12 has a smaller internal and/or external diameter compared with the area of gear chamber 20 and control chamber 23. Rotor chamber 26 is directly supplied with flowing water from the control chamber 23 and said water then passes out of rotor chamber 26 directly through the water exit connection 15. Base 12 essentially comprises two axially attached casing parts 27, 28 and an end cap 29, which are centred by inserting in one another and are interconnected in watertight manner by ultrasonic welding or the like. The rear casing part 27 forms the end or front collar passing through the rear end of the nozzle casing 7 and the gear chamber 20 and reversing chamber 23 over most of the axial extension thereof. With its rear, external diameter-reduced end, the front casing part 28 is inserted in centred manner in the front end of casing part 27, whose internal diameter is increased in complementary manner and forms at a limited distance upstream of the rear casing part 27 a partition 30 roughly at right angles to central axis 13 and constructed in one part therewith and which spatially separates the rotor chamber from control chamber 23 and sealingly separates it from the gear chamber 20. In the rear region the rear casing part 27 forms an endwall 31 constructed in one piece therewith and by means of which said end collar projects rearwards and carries the front end of hollow shaft 10.

The rear casing part 27 also forms a partition wall 32 constructed in one piece therewith and which is connected both to the end wall and to the inner circumference of the casing jacket of said casing part 27 on facing sides and after attachment of the front casing part 28 is also tightly connected to the associated side partition 30. This approximately planar partition wall 32 parallel to an axial plane of the casing is transversely displaced with respect to gear 19 with respect to said axial plane roughly by its thickness, so that the gear chamber 20 has a smaller capacity than the control chamber 23. A sleeve-like water inlet connection 33 in one piece with endwall 31 projects from the latter into the casing over part of the height of partition wall 32. Connection 33 partly penetrates the partition wall 32 constructed in one piece therewith, but in the vicinity of its inner end face is circular segmentally open only towards the control chamber 23 and is closed to the gear chamber 20. The water inlet connection 33 has an internal thread, into which is screwed the hollow shaft 10 with the external thread provided on its front end in such a way that the end face is braced with respect to the closed part of the inner end of the water inlet connection 33.

The turbine wheel 25 of drive rotor 24 has a rotor shaft 34 inserted in the hub with a diameter of only approximately 2 to 3 mm, whose end projecting over the rear face of turbine wheel 25 traverses a bearing bush 35 and is sealed in the bearing opening of the latter with an annular seal 36. The bearing bush 35 forming a closed component with the drive rotor 35 and a rotor pinion 37 and whose external diameter is slightly larger than that of the rotor pinion 37, is so sealingly inserted from the side of rotor chamber 26 into an opening in partition 30, that part of the circumference of pinion 37 projects into the gear chamber 20 and there produces the driving connection of drive rotor 24 with gear 19. The end of rotor shaft 34 more remote from the turbine wheel 25 located on the side of bearing bush 35 further therefrom and rotor pinion 37 can be mounted in a bearing boss of partition 30 projecting into gear chamber 20 and which sealingly engages in a corresponding cutout of partition wall 32 and is consequently precisely oriented and additionally supported.

Roughly symmetrically on either side of an axial plane of means 24 or base 12 roughly at right angles to partition wall 32, gear 19 has a cylindrical pin-like gear shaft 39 or 40, each of which is mounted with its front end in casing part 28 or in a blind bore of partition 30 and with its rear end in a blind bore of casing part 27. On each gear shaft 39, 40 is arranged in axially following manner a plurality of identical, stepped gear wheels 41, 42, 43. In each case the diameter-smaller gear wheel stage of one gear shaft drives the diameter-larger gear wheel stage of the other gear shaft. The larger diameter gear wheel stage of a first gear wheel 41 of gear shaft 39 is directly driven by the rotor pinion 37, whilst a smaller diameter gear wheel stage of the last gear wheel 43 of the same gear shaft 39 forms a driven pinion 44 of gear 19, which has a larger diameter than the remaining smaller gear wheel stages and projects through a window 47 over the inner circumference of an inner end collar 46, which is located concentrically within a collar 45 engaging in the rear endwall of nozzle casing 7.

In the vicinity of driven pinion 44 the two end collars 45, 46 are interconnected by an approximately shell-like pinion casing constructed in one piece therewith and which covers the driven pinion 44 over most of its circumference, namely up to the area projecting over window 47 and also on the rear end face and forms a bearing shoulder projecting into a bearing opening of driven pinion 44, in whose blind hole is mounted the rear end of gear shaft 39. The rear end of gear shaft 40 also extends over part of the axial extension of end collar 46, whose associated area is reinforced for receiving said rear end with a corresponding bearing stud.

The outer circumferences of the equal diameter, larger gear wheel stages of gear wheels 41, 42, 43 extend close to the associated side of the partition wall 32 and close to the inner circumference of the jacket of base 12 or gear chamber 20. As can be gathered from FIG. 3, in the vicinity of gear chamber 20, said jacket is provided on the inner circumference with a recess for receiving the gear wheels, so that it is thinner in this area than in the remaining areas.

For making a drive water jet act on the turbine wheel 25, there are two roughly tangentially, oppositely directed drive nozzles 48, 49 directed against the circumference of the said turbine wheel, whereof one determines the rotation direction in one sense and the other the rotation direction in the opposite sense. The nozzle openings 48, 49 are line connected to the control chamber 23 by means of drive nozzle ducts 50, 51 roughly axially parallel to base 12. The drive nozzle ducts 50, 51 project from partition 30 substantially freely into reversing chamber 23 and also from partition 30 forwards approximately to the end cap 29 into the rotor chamber 26.

The parts of the drive nozzle ducts 50, 51 projecting into control chamber 23 are formed by two cross-sectionally elongated, rectangular duct connections 52 located symmetrically on either side of the axial plane 38 and whose median planes roughly parallel to axial plane 38 are parallel to one another. The parts of drive nozzle ducts 50, 51 projecting into rotor chamber 26 are formed by separate duct portions 53 line connected to one of the duct connections 52 via a passage opening in partition 30, are connected to the diameter-reduced casing jacket of the front casing part 28 with their sides remote from turbine wheel 25 and in the direction of the latter become cross-sectionally narrower, in that their adjacent walls diverge cross-sectionally towards wheel 25, whilst their remote walls are located substantially parallel to one another in the planes of the associated walls of duct connections 52. The sides of duct portions 53 facing rotor shaft 34 are closed up to the rear end face of turbine wheel 25 and following on to this are open forming the nozzle openings of drive nozzles 48, 49. The front ends of the duct portions 53 remote from partition 30 are open prior to the fitting of end cap 29 and are closed by end closures 54 on mounting cap 29. Said end closures project in integral plate-like manner from the inside of the end wall of end cap 29, so that it is very easy to manufacture the casing from plastic.

Figure 4:
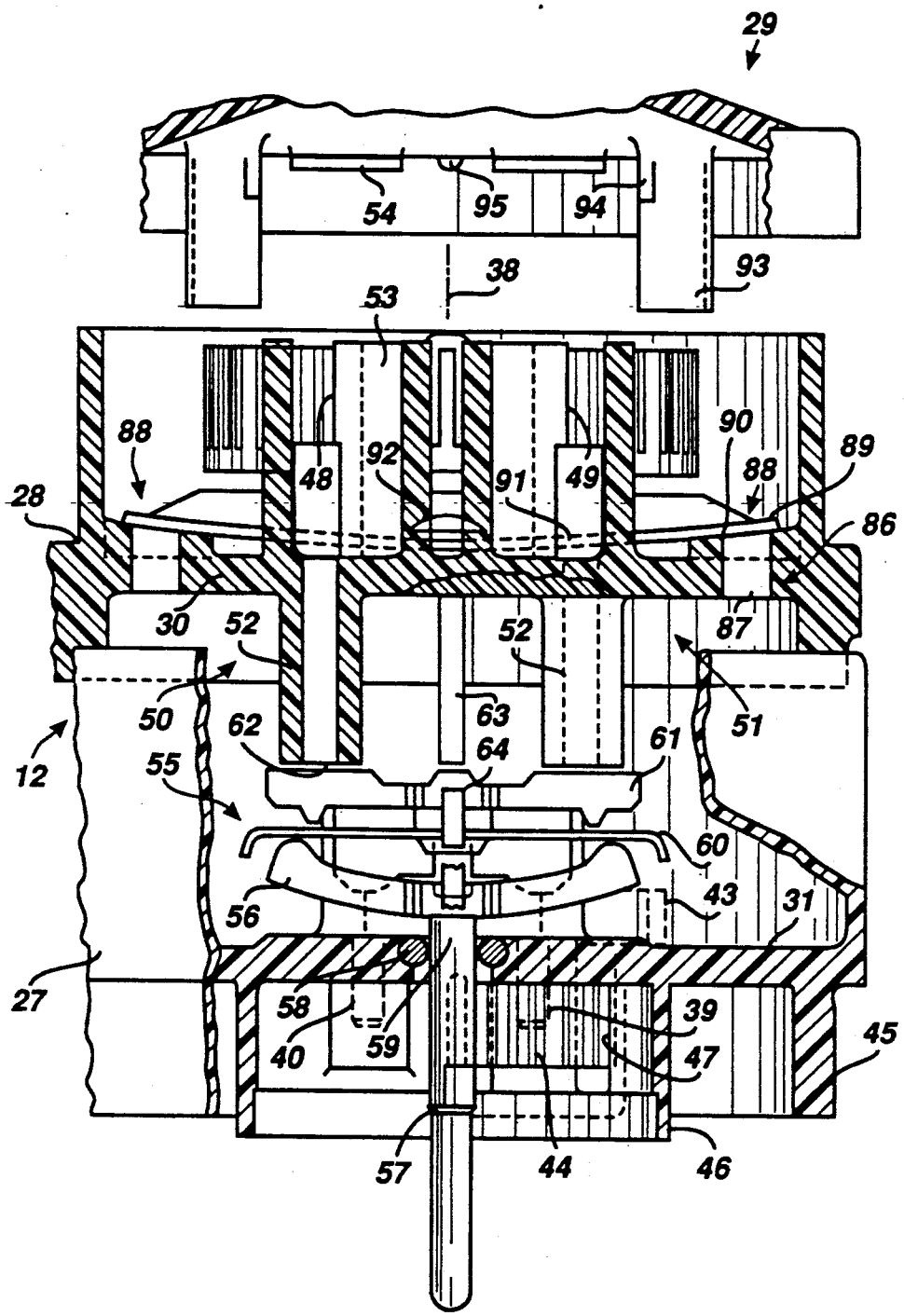
FIG. 4 shows the hydraulic motor according to FIG. 3 in a view from the left and partly in section or cut open form.

The reversing device 21 or reversing valve 22 has a reversing member 56 for performing a control movement and which is pivotable about an axis at right angles to the casing axis and preferably located in axial plane 39 between two end poisitons over a relatively small angle and is shown in FIG. 4 in its central position. For pivotable mounting purposes the reversing member 55 has an approximately T-shaped rocker 56, whose T-top web is located within the control chamber 23 and whose T-base forms a control bolt 57 movably passing through end wall 31, but sealed with an annular seal 58 in such a way that the free end of bolt 57 projects rearwards over the end collars 45, 46. The control bolt 57 is located between these end collars 45, 46. On either side of the control bolt 57 the rocker 56 has on the associated side of the T-top web in each case one bearing edge 59 projecting against end wall 31 with which it is so supported in the vicinity of the inner end face of wall 31 on either side of seal 58, that the swivel axis is located in the plane of said inside and at right angles to the T-top web in the centre of its length.

Rocker 56 is provided for operating a plate or strip-like valve body 61 substantially parallel thereto, which is formed by a leg of an angle profile and is located between the T-top web of rocker 56 and the free ends of drive nozzle ducts 50, 51 or duct connection 52. Valve body 61 is substantially only connected by engaging support with the rocker 56, accompanied by the interposing of a strip-like leaf spring 60, which only engages on the cam-like ends of the T-top web concavely curved corresponding to leaf spring 60 and consequently forms a subassembly with valve body 61 through centrally being traversed by a pin of said valve body 61 in a close and axially secured manner. The other leg of the valve body 61, which is slightly inwardly displaced with respect to the adjacent longitudinal edge of the valve body, engages in securing manner on the side of the T-top web of rocker 56 remote from the casing jacket.

With the valve body 61 or its slightly raised end portions remote from the rocker 56 are associated as valve seats 62 the closely facing end faces of the duct connection 52 faced by the valve body 61 in an axial area of base 12, which roughly coincides with the inner end face of the water inlet connection 33. In each swivel end position of rocker 56 one of the two valve seats 62 is closed and the other open. Valve body 61 is moved out of the central position according to FIG. 4 initially via the central connection with leaf spring 60 and then via one of the facing cams and can be pressed by the associated cam of rocker 56 against the valve seats 62. The valve body 61 is secured against lateral movement towards valve seats 62 by a counterholder 63 positioned between the valve seats 62 and which is formed by a web freely projecting from partition 30 in much the same way as duct connection 52 and faces a central projection of body 61. The valve body 61 is secured against longitudinal displacements by at least one locking device 64 facing casing 12, which is appropriately formed by an axial web on the inside of the casing jacket and/or on the outer circumference of the connecting piece forming the water inlet connection 33 and engages in a corresponding groove in the centre of the associated longitudinal edge of valve body 61 with an adequate transverse clearance. The webs forming the locking device 64 also engage in corresponding grooves of the T-top web of rocker 56 with an even larger transverse clearance. Once the rubber elastic valve body 61 has been swung into a working position, then it is held therein by the hydraulic pressure until it is transferred to the other valve position by means of rocker 56.

A blade rim 65 formed by an external circumferential tooth system is rotatably mounted on hollow shaft 10 within end collar 46 and meshes with the smaller diameter driven pinion 44 and is axially displaceable with respect thereto. Up to a predetermined torque, the blade rim 65 is secured in non-rotary or positive manner with respect to support 5, which produces the driving connection between the hydraulic motor 11 or nozzle casing 7 and post 3.

For adjusting the swivel angle and range, the reversing device 21 has two ring-like adjusting members 66, 67 rotatable about central axis 13 and connected directly to the rear end of base 12, whereof one surrounds with a flange the rear end of base 12 or end collar 45, whilst the other, identically constructed adjusting member 66 projects rearwards in the opposite direction with its flange. The adjusting parts 66, 67 are mounted with two directly interlinked hubs 68, 69 on a bearing sleeve 70 of support 5 projecting freely towards hydraulic motor 11 and which spacedly surrounds the hollow shaft 10 and is provided in the vicinity of hubs 68, 69 with a relatively easily overcomable locking corrugation system for the engagement of corrugation segments of hubs 68, 69, so that the adjusting parts 66, 67 can only be rotated with a certain amount of difficulty and are securely held in the in each case set position.

Each adjusting part 66, 67 has a gripping attachment 71, 72 projecting in link plate-like manner over the outer circumference of its flange and located at the end of an outer flange segment of the associated adjusting part 66, 67 in such a way that its flange segments and the grip attachments 71, 72, when the adjusting parts 66, 67 are engaged, are located in a common plane and the flange segment of one grip part engages over the outer circumference of that of the other grip part.

In the annular disk-like areas of adjusting parts 66, 67 connecting the flanges and hubs 68, 69 are provided segmental slots 73, 74 for the engagement or passage of the control bolt 57, whose ends form driving stops for bolt 57. By reciprocal rotation of the adjusting parts 66, 67 the reciprocal spacing of the driving stops can be varied and by a joint rotation of parts 66, 67 their position can be varied with respect to an axial or reference plane.

In order that the last-mentioned adjusting possibility is limited to a predetermined adjustment range is provided a stop 75 of support 5 adjacent to the outside of bearing sleeve 70 and projecting in the same direction of the latter and which engages in corresponding slots of the annular disk-like areas of adjusting parts 66, 67 roughly diametrically facing slots 73, 74. In order that the rocker 56 or its control bolt 57 cannot be overloaded after reaching its end position, a protective bolt 76 is provided in freely rearwardly projecting manner on base 12 and with it are associated in the annular disk-like areas of adjusting parts 66, 67 stop faces, which are circumferentially displaced with respect to the driving faces of slots 73, 74 and can be formed by stepped end faces of said slots 73, 74. Protective bolt 76 is located on the side of control bolt 57 remote from casing axis 13 and between the end collars 45, 46 projects freely rearwards from end wall 31 by roughly the same distance as control bolt 57, so that prior to the fitting of the hydraulic motor 11 in support 5, it also forms a shield for the control bolt 57.

The operation of the reversing device can also be gathered from German patent 19 12 315, to which reference should be made for further details and effects.

The driven shaft of hydraulic motor 11 formed by the driven pinion 44 is drive-connected to the post 3, accompanied by the interposing of a safety clutch 77 located within support 5 and which acts between the blade rim 65 and the bearing sleeve 70. For this purpose the blade rim 65 is located at the end of a cup-shaped intermediate sleeve 78, which is mounted with a predetermined radial clearance within the bearing sleeve 70 and on the hollow shaft 10 in that its rear end forming the bottom of the cup is directly guided on the circumference of shaft 10, whilst its front end having the blade rim 65 is mounted on shaft 10, accompanied by the interposing of a guide sleeve 83 inserted therein. The rear end of intermediate sleeve 78 forms a coupling member 79 of safety clutch 77, whilst the other coupling member 80 is formed by an internal, collar of bearing sleeve 70 traversed by hollow shaft 10 and located between the sleeve ends, whose end remote from the rim 65 serves to support an end or shaft collar 84 of shaft 10, accompanied by the interposing of at least one seal 85 or an axial slip ring.

The rear end face of coupling member 79 and the front end face of coupling member 80 have complementary end teeth 81 passing over the circumference and the individual teeth have on either side lateral flanks inclined in such a way that they become narrower towards their head faces. Between the coupling member 79 and guide sleeve 83 is provided a pretensioned coupling spring 82 constructed as a helical compression spring and located within the intermediate sleeve 78 and around the hollow shaft 10. It forces the coupling member 79 of the intermediate sleeve 78 axially displaceably positioned on guide sleeve 83 into engagement with coupling member 80. If casing 12 and support 5 are loaded against one another by an excessive torque, then the teeth of coupling members 79, 80 jump over one another. The coupling member 79 is axially displaced under the flank pressure of the teeth counter to the tension of coupling spring 82 and through a corresponding fine tooth pitch, it is ensured that the coupling member 79 returns in virtually any rotary position to its rotation-locked engagement with coupling member 80.

Between reversing chamber 23 and rotor chamber 26 is provided a bypass water distribution means 86 avoiding the nozzle ducts 50, 51 and which limits to a constant amount the water quantity used for driving the hydraulic motor 11 substantially independently of the water quantity supplied through the water inlet connection 33, so as to obtain an approximately constant motor speed. The excess water quantity flows through passage openings 87 in partition 30 outside the outer circumference of turbine wheel 25 directly into the rotor chamber or against the casing jacket, the remote lateral faces of the duct portions 53 and a platform-like protuberance of partition 30 into rotor chamber 26, from where it is passed with the water for driving the turbine wheel 25 passing out through in each case one of the drive nozzles 48, 49 through the water outlet connection 15 to the nozzles 8 of nozzle casing 7.

Figure 3:
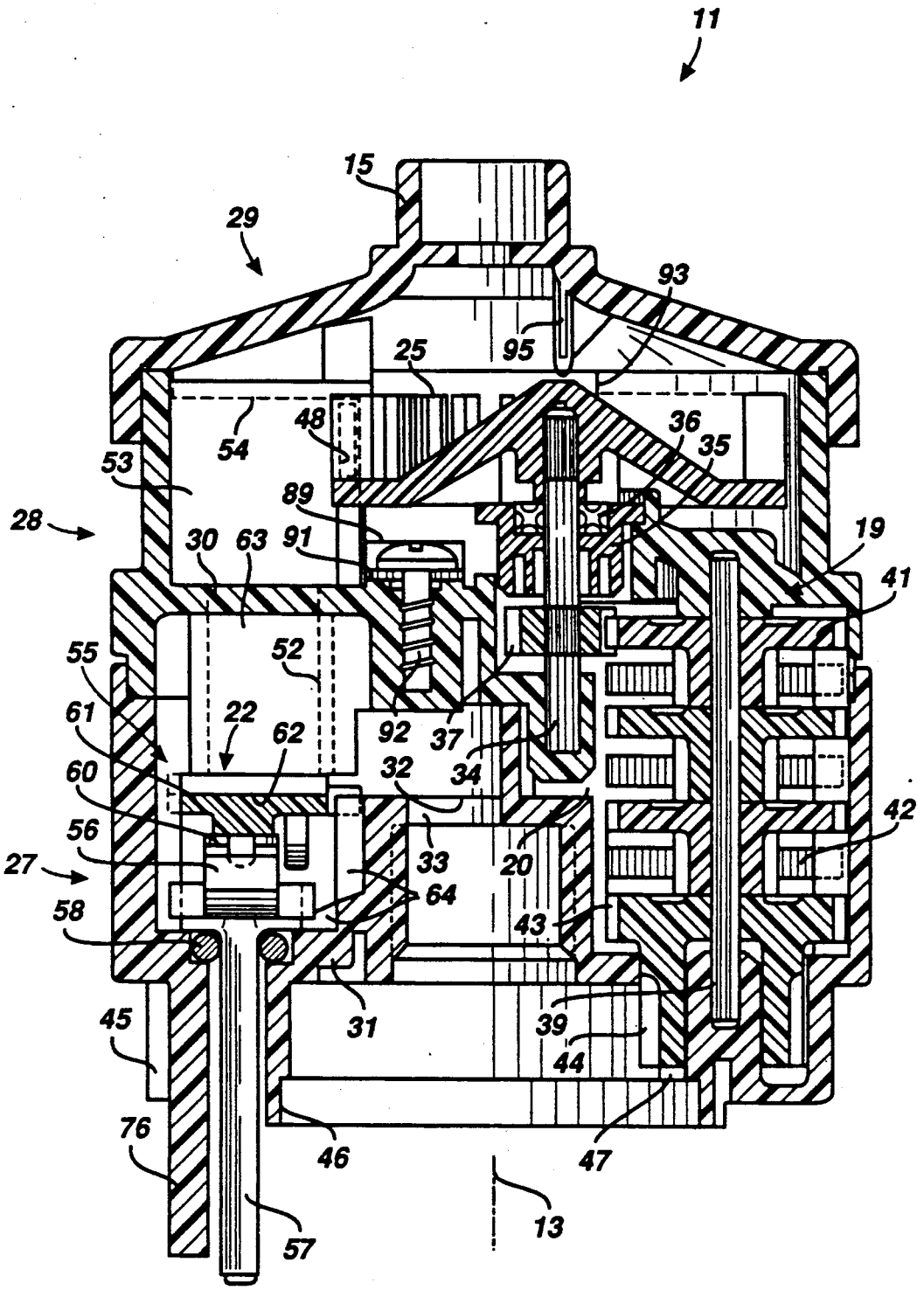
FIG. 3 shows the hydraulic motor according to FIG. 2 on a larger scale.

Considered parallel to the axial plane 38 according to FIG. 4, the passage openings 87 are on either side laterally outside the duct portions 53 and, at right angles thereto or to the axial plane 38 according to FIG. 3, between the duct portion 53 and the rotor shaft 34 or the platform-like protuberance mounting the same and securing the associated ends of the gear shafts 39, 40 close to the inner circumference of rotor chamber 26. Each opening 87 has an excess pressure valve 88, whose movable flap-like valve part formed by a valve body 89 admittedly operates independently of the other valve part, but is constructed in one piece therewith. The valve seat 90 of each excess pressure valve 88 located within the rotor 26 is formed by a protuberance of partition 30 rising shallowly to the casing jacket and surrounding the in each case associated opening 87 and on it the valve body 89 rests in flat manner under a predetermined spring tension. For producing this spring tension the two valve bodies 89 are formed by the widened ends of a flat spring strip 91 made from suitable metal, which in the vicinity of its central widened part between the valve bodies 89 is traversed by a bolt 92, e.g. a self-tapping screw and is tensioned therewith in the axial plane 38 for fixing against partition 30. On reaching a predetermined pressure gradient between control chamber 23 and rotor chamber 26 the valve bodies 89 rise from the valve seat 90, so that the bypass water distribution means 86 opens in pressure-dependent manner.

Apart from the end closures 54, on the inside of end wall of end cap 29 are provided curved, plate-like guide members 93 in integral manner, which surround the turbine wheel 25 over part of its circumference following on to the remote sides of the drive nozzles 48, 49 or the duct portions 53. The passage openings 87 are substantially located outside the outer circumference of these guide members 93. With its end remote from the associated drive nozzle 48 or 49, each guide member 93 is connected to the inner circumference of the jacket of rotor chamber 26 due to the eccentric mounting of the turbine wheel 25, so that this inner circumference forms an extension of the guide member and a very high efficiency is obtained, because the water passing out of the particular drive nozzle 48 or 49 can leave the turbine wheel 25 substantially only in the direction towards the water exit connection 15.

On the inside of end wall of end cap 29 are also provided integrally projecting orienting attachments 94, which pass over the duct portions 53 on remote sides, so that the end cap 29 can only be fitted to casing part 28 in the correct fitting position. Finally, on the inside of end wall of end cap 29 there is an integrally projecting axial bearing journal 95 located in the rotor axis and whose tapered end faces the end face of a hub of turbine wheel 25 with a limited clearance and consequently limits the axial clearance of drive rotor 24. Substantially all the components of the described drive mechanism can be made from plastic or plastic-like materials. Only the leaf spring 60, coupling springs 82, spring strips 91 and bolt 92, together with the rotor shaft 34 and gear shafts 39, 40 need be made from metal.

As shown in FIG. 1, the hydraulic motor 11 is so fitted in the nozzle casing 7, that the gear 19 or gear chamber 20 is located above the water distribution system or control chamber 23, which is horizontal at the bottom. This makes it even more difficult for water to penetrate the gear chamber and for any water which may have penetrated it is possible to provide an appropriate drain or the like.

It is claimed:

1. A drive mechanism for a sprinkler comprising:

a base defining a central axis and adapted to be mounted on a support;

a hydraulic motor mounted on said base and having a liquid driveable drive rotor exposed to a liquid duct;

a gear chamber receiving a gear driven by said drive rotor and providing a drive output for driving an operation; and, a control chamber separate from said gear chamber and receiving control means for controlling said drive mechanism to perform different drive operations, wherein said separate control chamber and gear chamber are located adjacent to one another in a direction substantially transverse to said central axis.

2. The drive mechanism according to claim 1, wherein said control chamber and said gear chamber are separated from a rotor chamber receiving said drive rotor by a common partition transverse to at least one rotor axis of said hydraulic motor and said gear, said drive rotor traversing said common partition in a substantially sealed manner with a rotor shaft for a driving connection with said gear.

3. The drive mechanism according to claim 1, wherein said control means provides a reversing means provided for driving said hydraulic motor in opposite rotation directions, said reversing means comprising a reversing valve disposed to control a flow within said liquid duct and being positioned substantially adjacent to a rotor chamber receiving said drive rotor, said reversing valve being located in said control chamber providing a section of said liquid duct, said gear chamber being sealingly separated from said liquid duct.

4. The drive mechanism according to claim 1, wherein said control means is laterally displaced with respect to at least one of axes provided by said central axis, a rotor axis of said drive rotor and at least one gear axis of said gear, said control means being located laterally adjacent to and separate from said gear with respect to a direction transverse to said central axis.

5. The drive mechanism according to claim 1, wherein said control chamber is separated from said gear chamber by a partition wall substantially parallel to at least one of axes provided by said central axis, a rotor axis of said drive rotor and at least one gear axis of said gear, said partition wall being connected to at least one of walls providing an inner circumference and an end wall.

6. The drive mechanism according to claim 5, wherein said partition wall is located eccentric with respect to said central axis and is laterally bounding a frontal water inlet issuing into said control chamber.

7. The drive mechanism according to claim 1, wherein at least one of chambers provided by a rotor chamber receiving said drive rotor, said gear chamber and said control chamber is surrounded and bounded by a common casing jacket, a rotor axis of said drive rotor being displaced laterally from said gear and with respect to said central axis of said base.

8. The drive mechanism according to claim 1, wherein said control chamber and said gear chamber extend substantially over a same longitudinal portion of said central axis.

9. The drive mechanism according to claim 1, wherein said gear is a reduction gear train, having two parallel, juxtaposed gear shafts with alternately interengaging, stepped gear wheels, said gear shafts and said control means being located on either side of an axial plane of said central axis.

10. The drive mechanism according to claim 1, wherein in an axial plane of said central axis are located a rotor axis of said drive rotor and said control means laterally offset with respect to said rotor axis.

11. The drive mechanism according to claim 1, wherein an axial plane of said central axis provides a median plane of said control means laterally displaced with respect to said gear and arranged in said control chamber.

12. The drive mechanism according to claim 1, wherein said base bearing at least one of means provided by said drive rotor, said gear and said control means comprises two longitudinally chaining separate and peripheral casing parts subdivided in the vicinity of at least one of means provided by said gear and said control means.

13. The drive mechanism according to claim 1, wherein a rear separate and peripheral casing part of said base is located adjacent to a water outlet of said base and forms substantially a gear chamber, said casing part chaining to a following casing part receiving said drive rotor.

14. The drive mechanism according to claim 1, wherein a separate front casing part of said base is located adjacent to a water outlet of said base and forms substantially at least one of members provided by a rotor chamber, a common partition for said control chamber and said gear chamber, at least one front mounting support for at least one gear shaft of said gear and at least one duct section of a nozzle duct (51,50) provided for said drive rotor (24), said duct section projecting into said control chamber and being associated with a control valve.

15. The drive mechanism according to claim 1, wherein a front casing part of said base is located adjacent to a water outlet of said base and closed at a front end by an end cap having a water outlet connection and water guide members for guiding passing water to drive said drive rotor.

16. The drive mechanism according to claim 1, wherein a rear casing part of said base is closed by an end wall constructed integrally therewith and traversed by a driven output pinion of said gear, a water inlet connection being provided in said end wall.

17. The drive mechanism according to claim 1, wherein said base is a peripheral casing enveloping said chambers and mounted on said support with a hollow shaft arranged in non-rotary manner on said base.

18. The drive mechanism according to claim 1, wherein a hollow shaft (10) mounting said base on said support is fixedly threaded into a water inlet connection of said base, said hollow shaft providing a water inlet duct upstream of said drive rotor.

19. The drive mechanism according to claim 1, wherein relative and substantially coaxially to a shaft mounting said base on said support a rotor rim engaging an output pinion of said gear is rotatably mounted, said rotor rim being drive connected to said support.

20. The drive mechanism according to claim 1, wherein connected to a water inlet connection and a water outlet connection of said casing is provided a bypass water duct passing round said drive rotor with respect to a hydraulic drive duct for said drive rotor, said bypass water duct issuing into a rotor chamber receiving said drive rotor.

21. The drive mechanism according to claim 20, wherein said bypass water duct has at least one passage opening separate from at least one drive nozzle duct, said passage opening connecting said control chamber to said rotor chamber being provided in a common partition separating said control chamber and said rotor chamber.

22. The drive mechanism according to claim 20, wherein said bypass water duct is controlled with at least one valve located in said rotor chamber and provided to open and close said bypass water duct.

23. The drive mechanism according to claim 22, wherein at least one valve body of said valve is a valve spring tongue covering a passage opening in said rotor chamber when in a position closing said valve, said valve being controlled in a pressure dependent manner.

24. The drive mechanism according to claim 23, wherein ends of a spring strip located between drive nozzle ducts for said drive rotor and a rotor axis of said drive rotor provide two valve bodies, each of said valve bodies covering a passage opening located outside of at least one of members provided by an adjacent nozzle duct and a circumference of said drive rotor.

* * * * *